US008403706B2

(12) United States Patent
Wu

(10) Patent No.: US 8,403,706 B2
(45) Date of Patent: Mar. 26, 2013

(54) USB PLUG CABLE ASSEMBLY

(75) Inventor: Jerry Wu, Irvine, CA (US)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/279,247

(22) Filed: Oct. 22, 2011

(65) Prior Publication Data

US 2012/0100746 A1 Apr. 26, 2012

(30) Foreign Application Priority Data

Oct. 23, 2010 (CN) ..... 2010 1 0517513

(51) Int. Cl.
*H01R 13/648* (2006.01)

(52) U.S. Cl. ..... 439/607.46; 439/76.1; 439/607.55

(58) Field of Classification Search ..... 439/76.1, 439/607.41–607.52, 607.55
See application file for complete search history.

(56) References Cited

U.S. PATENT DOCUMENTS

| | | | | |
|---|---|---|---|---|
| 7,798,853 | B2 * | 9/2010 | Shi et al. | 439/607.58 |
| 7,909,632 | B2 * | 3/2011 | Wu | 439/353 |
| 7,955,114 | B2 * | 6/2011 | Wu | 439/352 |
| 2009/0117784 | A1 * | 5/2009 | Wu | 439/660 |
| 2009/0117785 | A1 * | 5/2009 | Wu | 439/668 |
| 2009/0318024 | A1 * | 12/2009 | Wu | 439/607.01 |
| 2010/0233907 | A1 * | 9/2010 | Wu | 439/607.58 |
| 2011/0034061 | A1 * | 2/2011 | Wu | 439/345 |
| 2011/0034062 | A1 * | 2/2011 | Wu | 439/350 |
| 2011/0104931 | A1 * | 5/2011 | Wu | 439/358 |
| 2011/0294339 | A1 * | 12/2011 | Wu | 439/391 |
| 2012/0045934 | A1 * | 2/2012 | Wu | 439/607.01 |
| 2012/0071020 | A1 * | 3/2012 | Wu | 439/449 |
| 2012/0071021 | A1 * | 3/2012 | Wu | 439/449 |
| 2012/0071033 | A1 * | 3/2012 | Wu | 439/660 |
| 2012/0100746 | A1 * | 4/2012 | Wu | 439/474 |

* cited by examiner

*Primary Examiner* — Ross Gushi
(74) *Attorney, Agent, or Firm* — Wei Te Chung; Ming Chieh Chang

(57) ABSTRACT

A cable assembly includes a plurality of contacts, an insulation housing and a metal shell assembled on the insulation housing. The insulation housing is molded outside the contacts and includes a fastening portion protruding from a rear end of an upper surface of the housing, and a pair of side arms rearward extending from the two sides of a rear surface of the fastening portion. The metal shell is assembled on the insulation housing and located behind the fastening portion. The fastening portion is substantially of U-shaped configuration with a pair of L-shaped cutout located on the two sides thereof and the two cutouts faces toward the outside. The metal shell includes a pair of clasping portions respectively frontward extending from the front surface of two side walls of the rectangular frame. The clasping portions are respectively inserted into their corresponding cutouts.

20 Claims, 8 Drawing Sheets

USB PLUG CABLE ASSEMBLY

FIELD OF THE INVENTION

The present invention generally relates to a USB plug cable assembly, and more particularly to a USB plug cable assembly with an improved shell.

DESCRIPTION OF RELATED ART

Universal Serial Bus (USB) is a serial bus standard to the PC architecture with a focus on computer telephony interface, consumer and productivity applications. The interface design of USB is standardized by the USB Implementers Forum (USB-IF), an industry standardized organization founded by computer and communication companies. And USB cables used to connect peripherals such as mouse devices, keyboards, PDAs, gametabs and joysticks, scanners, digital cameras, printers, external storage, networking components, etc. For many devices such as scanners and digital cameras, USB has become the standard connection method.

Most USB cable assemblies comprise a housing, a plurality of contacts assembled on the housing, a cable electrically connected to the contacts, a metal shell enclosing the housing, a cover assembled on the shell and surrounding the shell. In assembly, firstly the shell is assembled on the housing, and then the cover is attached on the outer surface of the shell. However, this assembling method make cable assembly have a big height so as not to fit for the need of present Correspondingly, it is desired to have a cable assembly with improved structure to address the problems stated above.

BRIEF SUMMARY OF THE INVENTION

Accordingly, an object of the present invention is to provide a cable assembly with low profile.

In order to achieve the above-mentioned object, the cable assembly comprises a plurality of contacts, an insulation housing molded outside the contacts, and a metal shell assembled on a rear portion of the insulation housing. The front cover encloses the insulation housing. The front cover comprises two pairs of projection portion respectively extending from two sides of the rear end of an upper and lower inner wall of the front cover. The metal shell comprises a pair of fastening pieces corresponding the projection portion to assembled the front cover on the metal shell.

Other objects, advantages and novel features of the invention will become more apparent from the following detailed description of the present embodiment when taken in conjunction with the accompanying drawings.

DETAILED DESCRIPTION OF THE INVENTION

Figure 1:
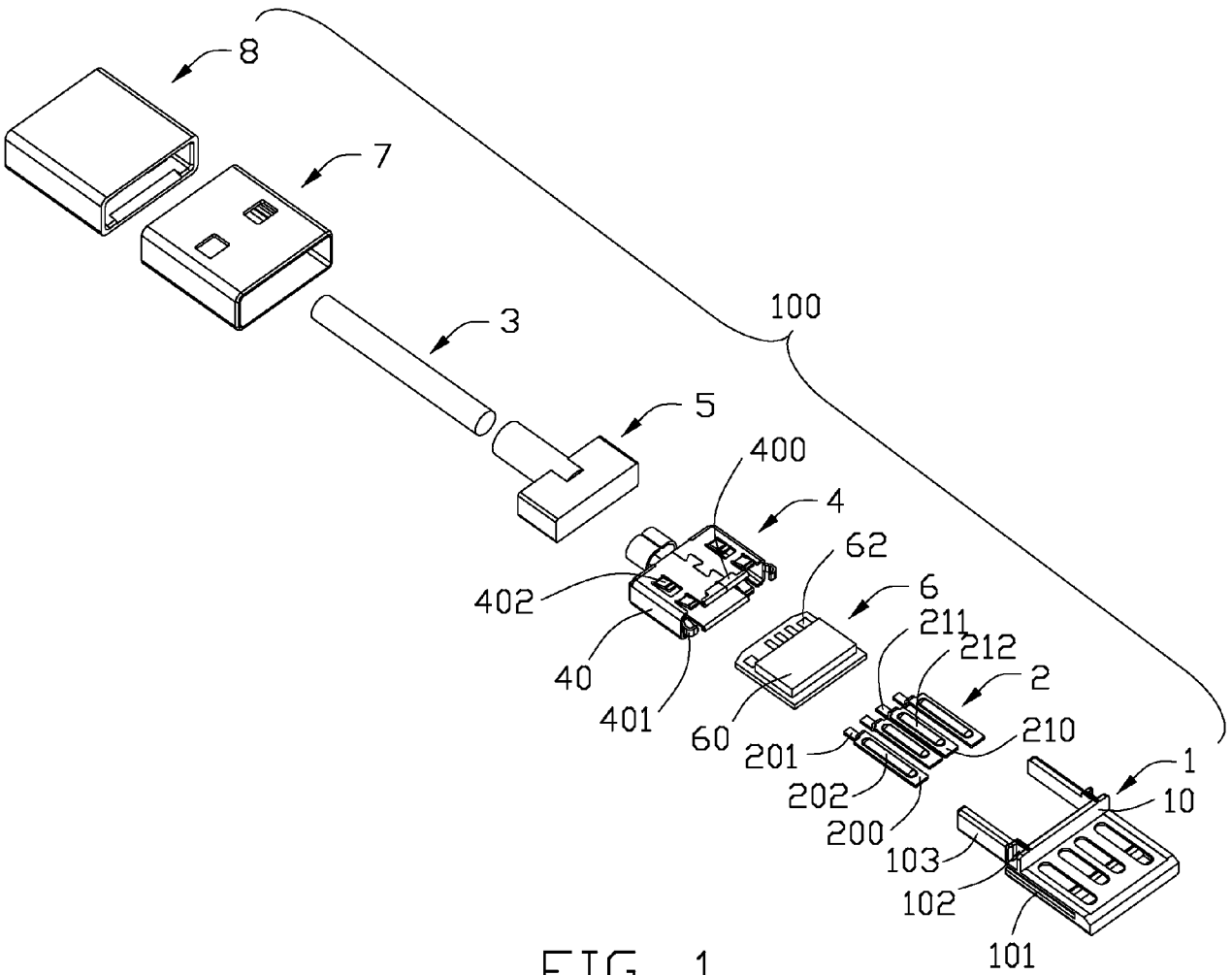
FIG. 1 is an exploded, perspective view of a cable assembly in accordance with the present invention.

Reference will now be made to the drawing figures to describe the present invention in detail.

Figure 2:
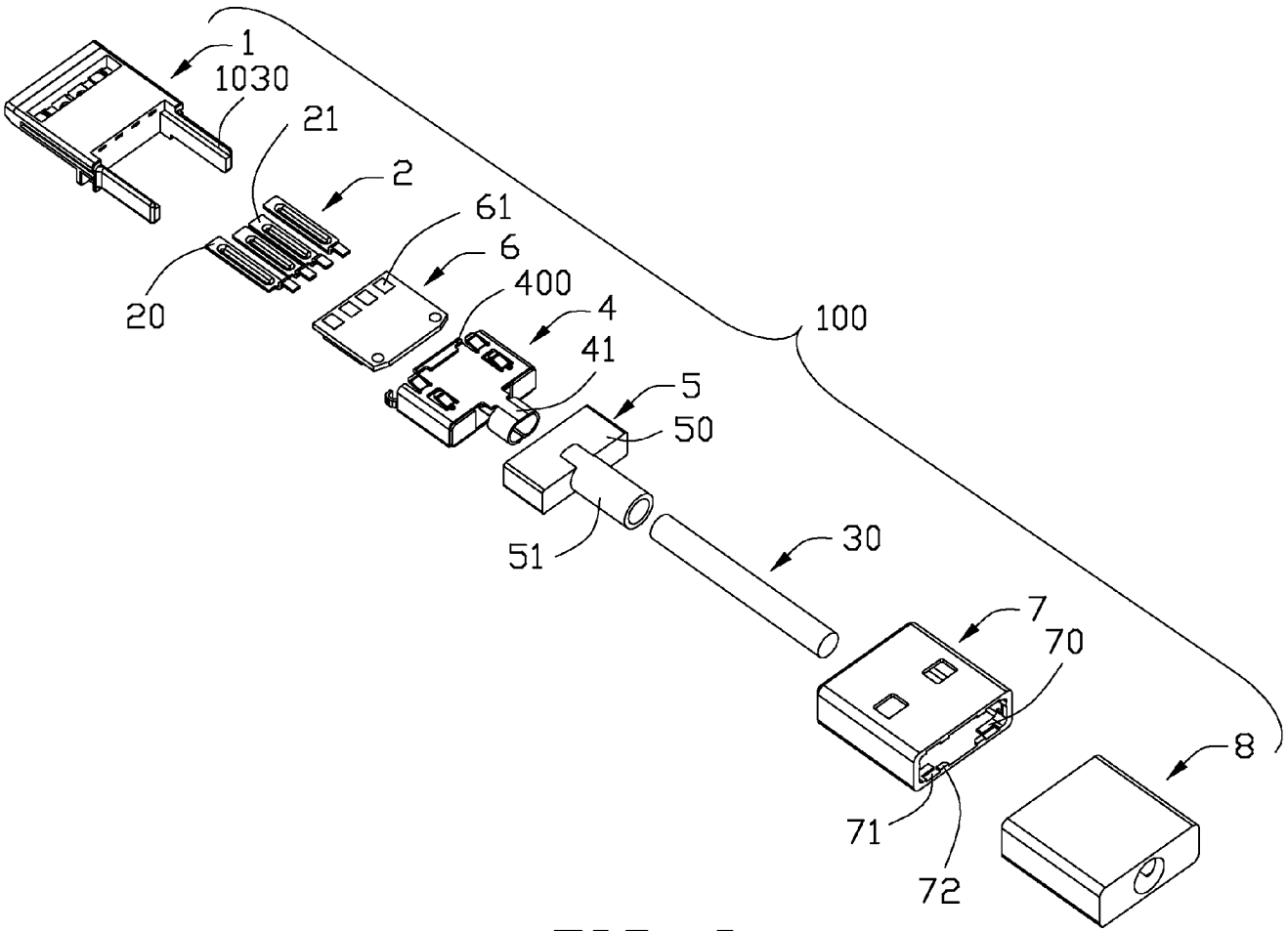
FIG. 2 is similar to FIG. 1, but viewed from another aspect.

Referring to FIGS. 1 to 2, a cable assembly 100 in accordance with the present invention comprises a plurality of contacts 2, an insulation housing 1 molded to surround the conducts 2, a cable 3 electrically connected to the contacts 2, a metal shell 4 assembled on the rear portion of the insulation housing 1, a front cover 7 covering the insulation housing 1 and a rear cover 8 covering the metal shell 4.

Figure 3:
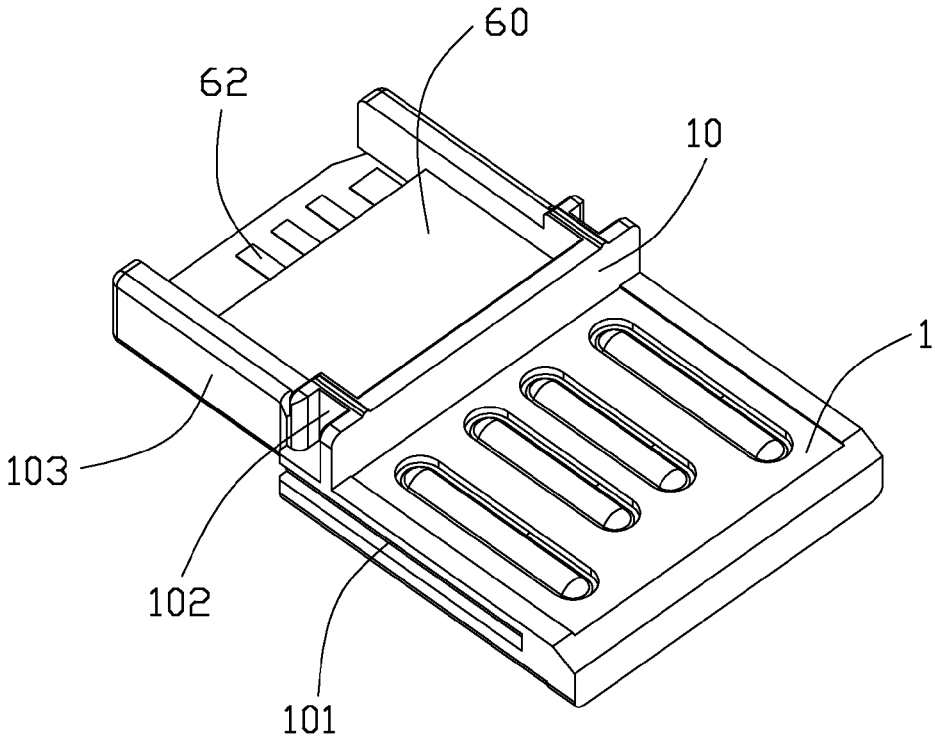
FIG. 3 is a perspective, partial assembled view of the housing and the contacts of the cable assembly of FIG. 1.
Figure 4:
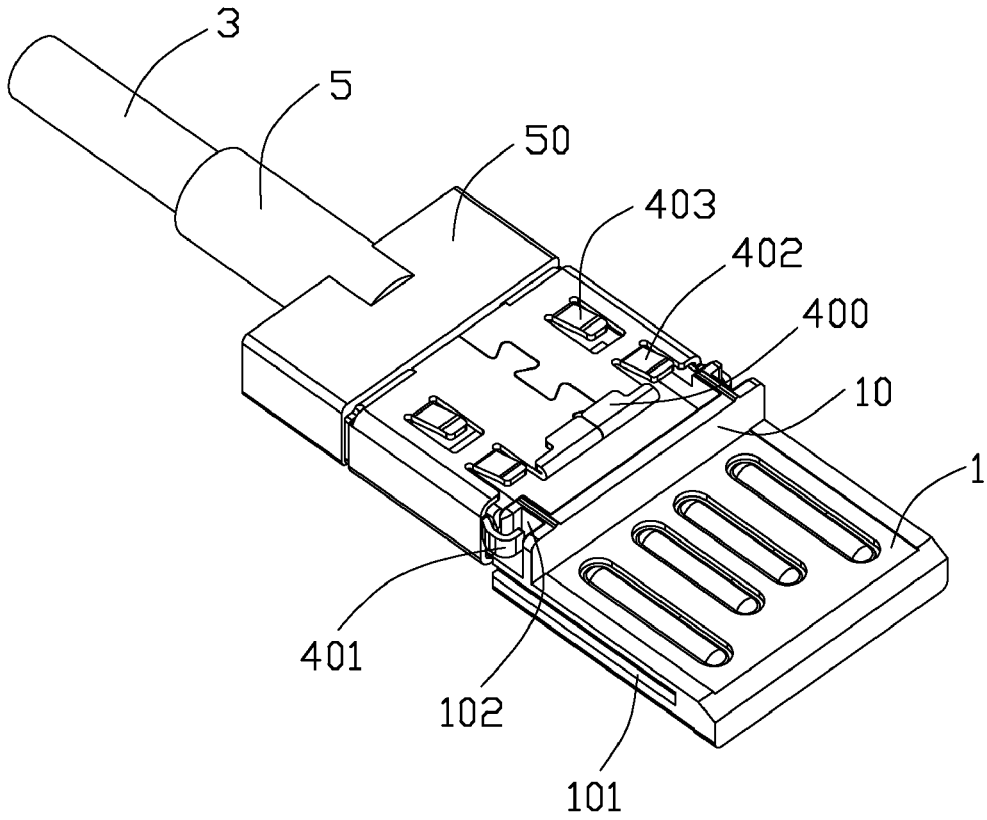
FIG. 4 is a perspective, partial assembled view of the cable assembly of FIG. 1.
Figure 5:
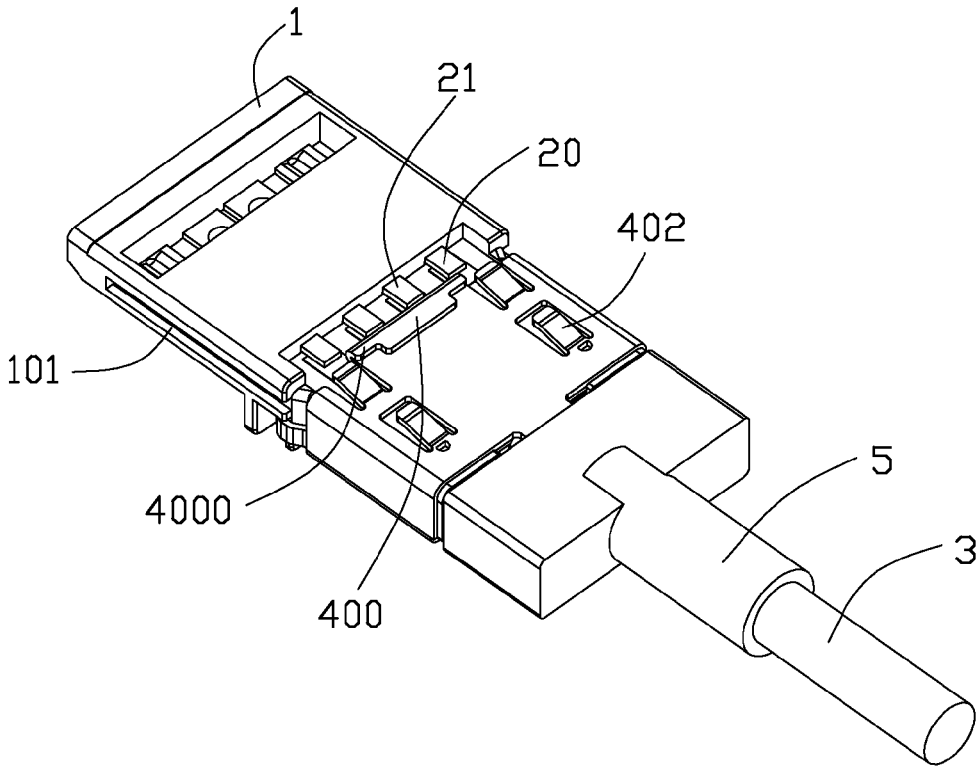
FIG. 5 is a perspective, partial assembled view similar to FIG. 1, but viewed from another aspect.
Figure 6:
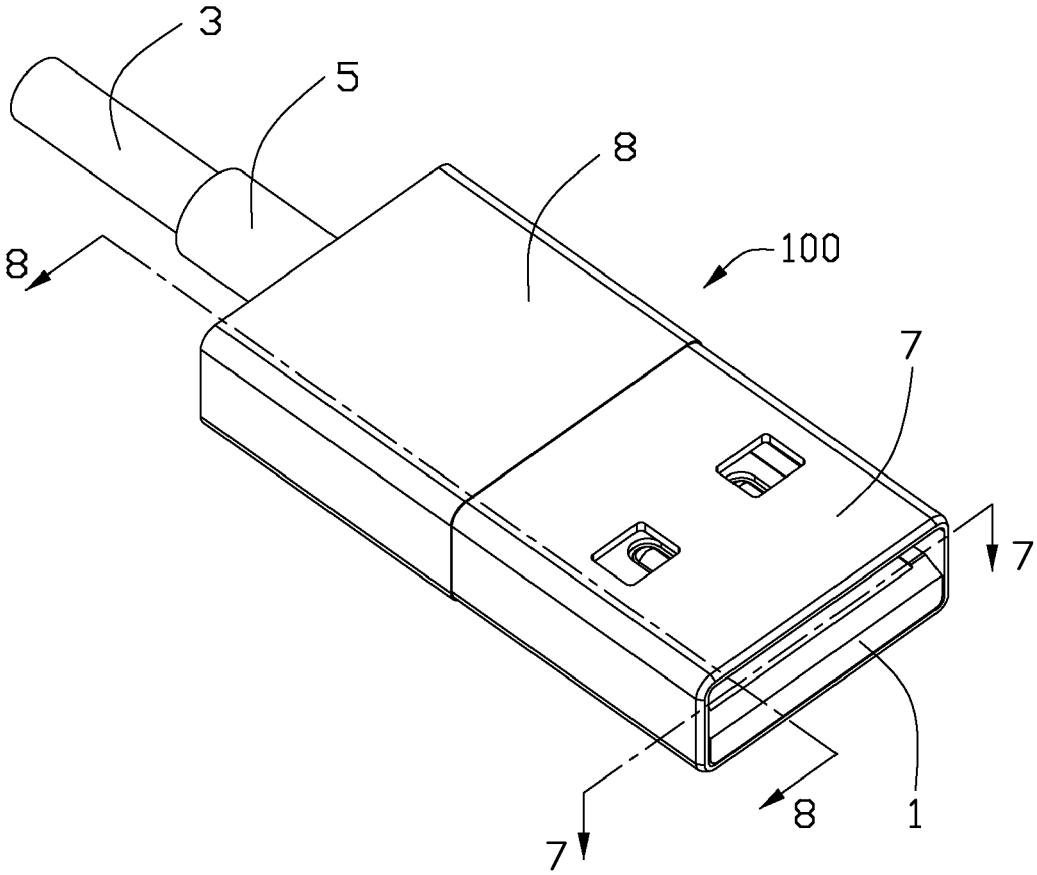
FIG. 6 is a perspective assembled view of the cable assembly of this present invention.

Referring to FIGS. 1 to 3, the insulation housing 1 is substantially of rectangular shape and comprises a receiving slots 101 located on the two side walls thereof and a fastening portion 10 protruding from the rear end of the upper surface of the housing 1. The fastening portion 10 is of U-shaped configuration with a pair of L-shaped cutout 102 located on the two sides thereof and the two cutouts 102 faces toward the outside. A pair of side arms 103 rearward extends from the two sides of the rear surface of the fastening portion 10. Each of the two side arms 103 comprises a L-shape groove 1030 located on the rear end of the side arm 103 and connecting the rear surface, the lower surface and the inner surface of the side arm 103.

In this embodiment, the cable assembly 100 has four contacts 2 which includes a pair of first contacts 20 located on two sides thereof and a pair of second contacts 21 located between the two first contacts 20. The first contacts 20 comprises a first fastening piece 200 and a first tail portion 201 rearward extending from the rear end of the first fastening piece 200. The second contacts 21 comprises a second fastening piece 210 and a second tail portion 211 rearward extending from the rear end thereof. Every fastening portion 200, 210 has a protrusion portion 202, 212 locate on the middle thereof. The tails 201, 211 of the first and second contacts 20, 21 are arranged in one row.

The cable 3 comprises a plurality of wires (not shown) and an insulation cover 30 enclosing the wires.

The metal shell 4 comprises a rectangular frame 40 and a crimping portion 41 rearward extending from the rectangular frame 40, a pair of fastening pieces 400 respectively outward and rearward extending from front ends of the upper surface and the lower surface of the rectangular frame 40, a pair of clasping portions 401 respectively frontward extending from the front surface of the two side walls of the rectangular frame 40, and a pair of first spring slices 402 and a pair of second spring slices 403 respectively located on the upper surface and the lower surface of the rectangular frame 40. Each fastening piece 400 comprises a pair of first gaps 4000 on the two sides of the end thereof.

The cable assembly 100 further comprises a stress releasing portion 5. The stress releasing portion 5 is substantially of rectangular configuration and comprises a rectangular portion 50 enclosing the crimping portion 41 and a extending portion 51 rearward extending from the rectangular portion 50 and enclosing the cable 3.

The printed circuit board 6 is fixed between the two side arms 103 and inserted into the grooves 1030 of the side arms 103. The printed circuit board 6 comprises a capacitance 60 attached on the upper surface thereof, a plurality of first golden fingers 61 located on the front end of the lower surface of the printed circuit board 6 in a row and connected to the tails of the first contacts 20 and the second contacts 21, and a plurality of second golden fingers 62 located behind the capacitance 60 on the upper surface of the printed circuit board in a row and connected to the wires of the cable 3.

The front cover 7 encloses the insulation housing 1 and the rear cover 8 encloses the metal shell 4 and the stress releasing portion 5. The front cover 7 is made of metal and the rear cover 8 is made of insulative material. Two pairs of depressed portions 80 are formed on the inner surfaces of the upper and lower walls to correspond to the spring slices 402.

Figure 7:
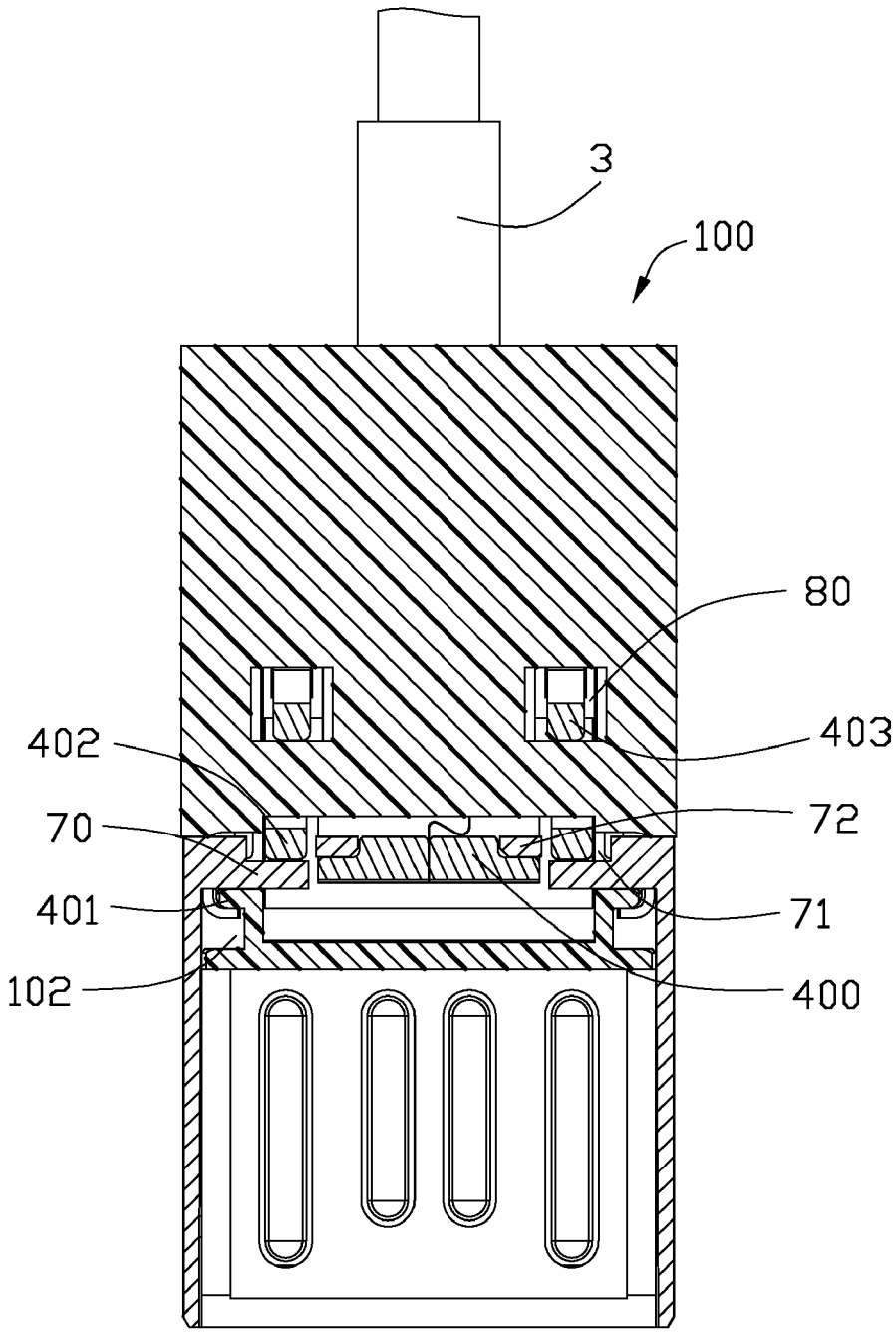
FIG. 7 is a cross-sectional view of the cable assembly taken along line 7-7 of FIG. 6.
Figure 8:
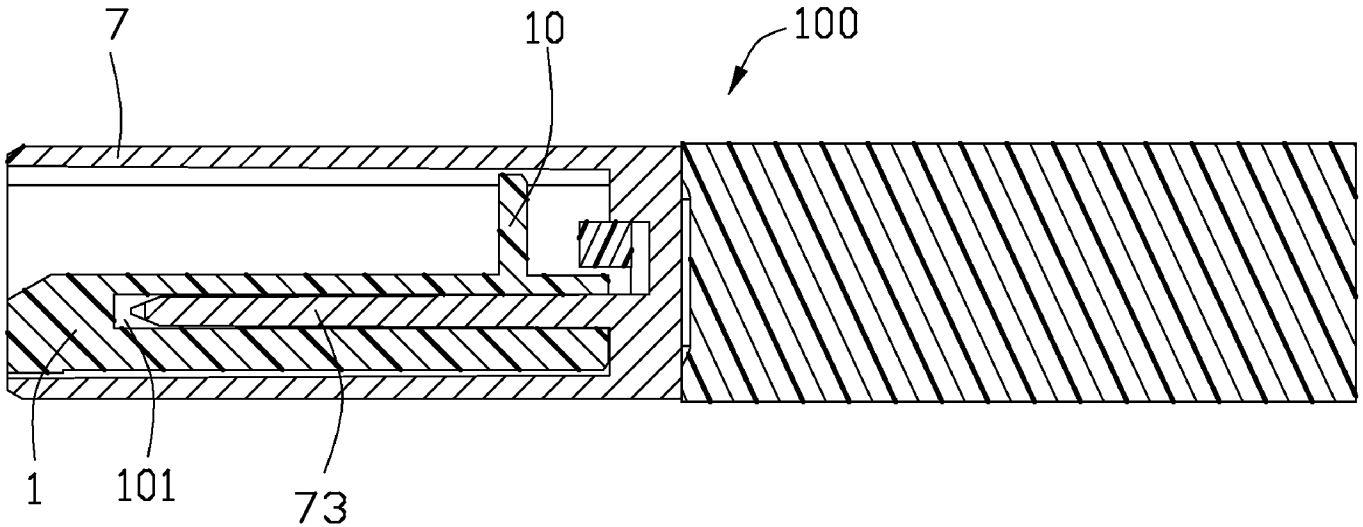
FIG. 8 is a cross-sectional view of the cable assembly taken along line 8-8 of FIG. 6.

Referencing to FIGS. 7-8, the front cover 7 comprises two pairs of projection portion 70 respectively extending from two sides of the rear end of an upper and lower inner wall of the front cover 7. The projecting portion 70 is attached to the fastening portion 10 and is substantially of L-shaped configuration to form a second gap 71 which is located between the projecting portion 70 and the rear surface of the front cover 7 and corresponding to the first spring slices 402. The first spring slices 402 is fastened into the second gap 71. Two pairs of poles 72 respectively inward extend from the upper and lower inner walls of the front cover 7 and is located between the second gaps 71. The poles 72 are fastened in to the first gaps 4000. A pair of rims 73 are formed on two side inner surfaces of the front cover 7 to be inserted into the receiving slots 101.

Referencing to FIGS. 1 to 8, in assembly, firstly, the insulation housing 1 is molded to fill and enclosing the first and second contacts 20, 21 with mating portions of these contacts being exposed to be connected to the outside of the insulation housing 1. At the same time, the tails 201, 211 of the contacts 20, 21 are exposed out the rear surface of the insulation housing 1 and located between the two side arms 103. Secondly, the printed circuit board 6 is assembled between the two side arms 103 and the tails 201, 211 of the contacts 20, 21 are soldered on the first golden fingers 61 of the printed circuit board 6. Thirdly, the wires of the cable 3 are soldered on the second golden fingers 62 of the printed circuit board 6. The metal shell 4 is assembled on the housing 1 with the metal shell 4 being located behind the fastening portion 10 and the clasping portions 401 being respectively inserted into their corresponding cutouts 102. At the same time, the crimping portion 41 catches the cable 3. Fourthly, the stress releasing portion 5 is molded to cover the crimping portion 41 and the cable 3. Fifthly, the front cover 7 covers a part of the housing 1 and is attached to the L-shaped rim 400. Lastly, the rear cover 8 covers the metal shell 4 and the stress releasing portion 5. In this embodiment, the structure that the metal shell 4 is fastened on the rear surface of the insulation housing 1 and the front cover 7 and the rear cover 8 respectively encloses the insulation housing 1 and the metal shell 4 can reduce the height of the cable assembly 100.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable assembly, comprising:

a plurality of contacts;

an insulation housing molded outside the contacts; and a metal shell assembled on a rear portion of the insulation housing;

a front cover enclosing the insulation housing; wherein the front cover comprises two pairs of projection portions respectively extending from two sides of the rear end of an upper and lower inner wall of the front cover, and the metal shell comprises a pair of fastening pieces corresponding the projection portions to assemble the front cover on the metal shell.

2. The cable assembly as claimed in claim 1, wherein said insulation housing comprises a fastening portion protruding from a rear end of an upper surface of the housing, and a pair of side arms rearward extending from the two sides of a rear surface of the fastening portion.

3. The cable assembly as claimed in claim 2, wherein the metal shell comprises a rectangular frame and a crimping portion rearward extending from the rectangular frame, the pair of fastening pieces respectively outward and rearward extends from front ends of the upper surface and the lower surface of the rectangular frame.

4. The cable assembly as claimed in claim 3, wherein said projecting portion is attached to the fastening portion and is substantially of L-shaped configuration to form a second gap which is located between the projecting portion and the rear surface of the front cover.

5. The cable assembly as claimed in claim 4, wherein the first spring slices is fastened into the second gap.

6. The cable assembly as claimed in claim 5, wherein the front cover further comprises two pairs of poles respectively inward extending from an upper and lower inner walls of the front cover and being located between the second gaps, and a pair of rims being formed on two side inner surfaces of the front cover.

7. The cable assembly as claimed in claim 6, wherein the insulation housing further comprises a receiving slots located on the two side walls thereof, and the pair of rims of the front cover is inserted into the receiving slots.

8. The cable assembly as claimed in claim 7, wherein the poles are fastened in to the first gaps.

9. The cable assembly as claimed in claim 3, wherein said metal shell further comprises a rectangular frame and a pair of L-shaped rims respectively outward and rearward extending from front ends of an upper surface and a lower surface of the rectangular frame.

10. The cable assembly as claimed in claim 9, further comprising a stress releasing portion, and a rear cover enclosing the metal shell and the stress releasing portion.

11. The cable assembly as claimed in claim 10, wherein said stress releasing portion is substantially of rectangular configuration and comprises a rectangular portion enclosing the crimping portion and a extending portion rearward extending from the rectangular portion and enclosing the cable.

12. The cable assembly as claimed in claim 11, wherein said metal shell further comprises a pair of clasping portions respectively frontward extending from an front surface of two side walls of the rectangular frame, and two pairs of spring slices respectively located on the upper surface and the lower surface of the rectangular frame.

13. The cable assembly as claimed in claim 12, wherein said rear cover further comprises two pairs of depressed portions formed on the inner surfaces of upper and lower walls thereof to correspond to the spring slices.

14. A cable connector assembly comprising:

an insulative housing embedded within a die cast metallic front shell via an insert molding process, said housing defining therein a mating face facing toward a mating port, in a vertical direction, formed by the front shell;

a plurality of contacts integrally formed with the housing via said insert molding process, each of said contacts defining a contacting section exposed upon the mating face in the vertical direction and a mounting section behind the front contacting section in a front-to-back direction perpendicular to said vertical direction;

a printed circuit board located behind the housing in said front-to-back direction and defining opposite front and rear edges in the front-to-back direction, the mounting sections of the contacts mounted around the front edge;

a cable including a plurality of wires mounted around the rear edge; and a metallic rear shell circumferentially shielding the printed circuit board; wherein said rear shell defines at least a front fastening section engaged with at least one of the housing and the front shell, and a rear fastening section grasping the cable.

15. The cable connector assembly as claimed in claim 14, wherein an insulative cover circumferentially encloses the rear shell behind the front shell in a coplanar manner.

16. The cable connector assembly as claimed in claim 15, wherein said rear shell defines a front projection engaged with the front shell, and a rear projection engaged with the insulative cover.

17. The cable connector assembly as claimed in claim 14, wherein the housing defines a pair of side arms to sandwiched therebetween and be grasped by the rear shell.

18. The cable connector assembly as claimed in claim 14, wherein the rear shell includes two front fastening sections respectively engaged with the housing and the front shell.

19. A cable connector assembly comprising:

an insulative housing embedded within a die cast metallic front shell, said housing defining therein a mating face facing toward a mating port, in a vertical direction, formed by the front shell;

a plurality of contacts disposed within the housing, each of said contacts defining a contacting section exposed upon the mating face in the vertical direction and a mounting section behind the front contacting section in a front-to-back direction perpendicular to said vertical direction;

a printed circuit board located behind the housing in said front-to-back direction and defining opposite front and rear edges in the front-to-back direction, the mounting sections of the contacts mounted around the front edge;

a cable including a plurality of wires mounted around the rear edge; and a metallic rear shell circumferentially shielding the printed circuit board; wherein said rear shell defines a first front fastening section engaged with the front shell and a second front fastening section engaged with the housing.

20. The cable connector assembly as claimed in claim 19, further including an insulative cover enclosing the rear shell, wherein the rear shell defines at least one protrusion engaged within the insulative cover.

* * * * *